US007644783B2

(12) United States Patent
Roberts et al.

(10) Patent No.: US 7,644,783 B2
(45) Date of Patent: Jan. 12, 2010

(54) POWER TOOL GEAR-TRAIN AND TORQUE OVERLOAD CLUTCH THEREFOR

(75) Inventors: Ana-Maria Roberts, Brandon (GB); David Proudlock, Shotton Clooiery (GB)

(73) Assignee: Black & Decker Inc., Newark, DE (US)

( * ) Notice: Subject to any disclaimer, the term of this patent is extended or adjusted under 35 U.S.C. 154(b) by 274 days.

(21) Appl. No.: 11/350,325

(22) Filed: Feb. 8, 2006

(65) Prior Publication Data

US 2006/0211534 A1 Sep. 21, 2006

(30) Foreign Application Priority Data

Feb. 9, 2005 (GB) ..... 05250721.7

(51) Int. Cl.
*B25B 23/14* (2006.01)

(52) U.S. Cl. ..... 173/178; 173/216; 173/217

(58) Field of Classification Search ..... 173/176, 173/178, 216, 217, 201, 48, 104, 109; 192/48.2, 192/56.4; 475/298, 265
See application file for complete search history.

(56) References Cited

U.S. PATENT DOCUMENTS

| | | | | |
|---|---|---|---|---|
| 4,448,098 | A | 5/1984 | Totsu | |
| 4,823,885 | A * | 4/1989 | Okumura | 173/178 |
| 4,842,078 | A | 6/1989 | Hansson | |
| 5,437,524 | A | 8/1995 | Huang | |
| 5,449,043 | A * | 9/1995 | Bourner et al. | 173/178 |
| 5,531,278 | A * | 7/1996 | Lin | 173/176 |
| 6,053,080 | A | 4/2000 | Kaneyama et al. | |
| 6,076,438 | A * | 6/2000 | Rahm | 81/473 |
| 6,093,130 | A | 7/2000 | Buck et al. | |
| 6,305,481 | B1 * | 10/2001 | Yamazaki et al. | 173/178 |
| 6,457,535 | B1 * | 10/2002 | Tanaka | 173/48 |
| 6,676,557 | B2 * | 1/2004 | Milbourne et al. | 475/286 |
| 6,863,165 | B2 * | 3/2005 | Koslowski | 192/48.2 |
| 6,984,188 | B2 * | 1/2006 | Potter et al. | 475/298 |
| 7,101,300 | B2 * | 9/2006 | Milbourne et al. | 475/265 |
| 7,168,503 | B1 * | 1/2007 | Teng | 173/48 |
| 7,314,097 | B2 * | 1/2008 | Jenner et al. | 173/48 |
| 7,410,007 | B2 * | 8/2008 | Chung et al. | 173/48 |
| 2003/0221928 | A1 | 12/2003 | Koslowski | |

FOREIGN PATENT DOCUMENTS

| | | |
|---|---|---|
| CH | 278074 | 1/1952 |

(Continued)

*Primary Examiner*—Scott A. Smith
(74) *Attorney, Agent, or Firm*—Michael Aronoff; Adan Ayala

(57) ABSTRACT

A power tool transmission is described in which an overload clutch mechanism is arranged to provide a relatively compact power tool. A torque adjustment dial is arranged between the visible portions of the motor housing and the gearbox, and the dial is coupled to a compression spring such that rotation of the dial cause the spring to be compressed or decompressed, thereby adjusting the torque at which the clutch overloads and ratchets. The compression spring is arranged at least partially between the motor and gearbox or gear train, in a space which conventional power tools do not utilized for this purpose. Thus, the dimensions of the power tool's transmission can be reduced with respect to conventional power tools. Furthermore, the space on the gearbox immediately behind a chuck can be used for another purpose other than accommodating the adjustment collar, as is the case with conventional power tools.

20 Claims, 5 Drawing Sheets

FOREIGN PATENT DOCUMENTS

| | | | |
|---|---|---|---|
| DE | 33 42 880 | A1 | 6/1985 |
| DE | 36 36 302 | A1 | 4/1988 |
| DE | 39 19 648 | A1 | 12/1990 |
| EP | 0 132 774 | A1 | 2/1985 |
| EP | 0 302 229 | A2 | 2/1989 |

* cited by examiner

POWER TOOL GEAR-TRAIN AND TORQUE OVERLOAD CLUTCH THEREFOR

FIELD OF THE INVENTION

This invention relates to a power tool having a gear train and torque overload clutch. In particular, this invention relates to hand-held motor driven electric power tool, but it might equally be applicable to other forms of power tools.

BACKGROUND OF THE INVENTION

It is known for hand-held motor driven power tools, particularly screwdrivers, to incorporate a clutch overload mechanism, usually in the gearbox. The clutch is arranged to interrupt or break the drive train when a torque force applied to the power tool's output exceeds a threshold value. This can be achieved by causing components of the gear train to slip or ratchet with respect to one another. In this instance the motor continues to operate but the gearbox output, and hence the tool bit, does not rotate. Thus, the clutch can be used to prevent a nut or screw from being tightened beyond a certain torque (at which the thread might be stripped, for instance).

The gear train in conventional power tools usually has two or more gear reductions, and often incorporates a speed change facility. The gears are typically epicyclical, or planetary-type gears which provide relatively high reduction ratios for a compact size or volume. Such a gearbox for a power tool is described in EP0613758A1.

Conventional motor powered screwdrivers have the clutch arranged on the output gear of the gear train. Overload clutches are often of the ball-clutch type where a ball sits in a socket on a gear ring, as exemplified in EP0613758A1. The ball is urged into the socket by a load or force applied by a spring. The spring force can be varied by the user by adjusting a torque adjustment collar disposed around the gearbox output between the gearbox and chuck. Adjustment of the collar changes the compression of the spring, and hence the force applied by the spring to the ball-clutch. The torque required to cause the clutch to slip varies according to the spring's compression and/or the position of the collar. A clutch may employ pins, rather than balls, as described in EP1445074A1.

Disposing the clutch on the output gear of a reduction gear train (for instance, the third gear in a three gear train) results in a relatively high torque force being required before the clutch slips. This in turn requires a relatively large force applied to the clutch mechanism in order to maintain the clutch parts from slipping. As a result, a relatively large and heavy spring is required to apply the necessary forces.

To reduce the spring's size and weight, the clutch can be arranged on different parts of the gear train, where a lower torque force is required. For instance, the clutch can be arranged on a gear closer to the motor drive for a reduction gear train. In this arrangement, for conventional motor driven screwdrivers, the clutch adjustment collar (which the user sets the torque force at which the clutch ratchets) and spring are arranged around the gearbox output, extending from the chuck-end of the gearbox and adding to the length of the power tool. A transfer mechanism is required to apply the spring load to the clutch mechanism. The transfer mechanism is arranged to apply the load either through the gears, or around the gears. Such a transfer mechanism usually comprises link-pins or the like to couple the spring to the clutch plates. As a result, the weight saving achieved by reducing the spring size is minimised by the increased weight caused by the transfer mechanism.

EP302229A2 describes a clutch mechanism disposed on a third planetary gear. A range of torque can be set by adjusting a torque setting knob which adjusts the biasing force of a spring. The spring urges balls into recesses on the third gear. When the torque exceeds a load the third gear ratchets over the balls. Axial movement of the gear causes backward movement of slide pins which are connected to a gear of the first planetary gear. The pins act to push a brake disk, which normally stops the movement of the first gear, thereby allowing free movement of the first gear when the clutch ratchets.

In multi-speed multi-gear reduction gearboxes, there are problems associated with a clutch mechanism which is arranged on a gear after (or down stream of) a speed-change mechanism. The problem is that the torque clutch has a limited range over each speed. This is so because at a high speed setting (for a reduction gearbox) only some, and not all of the gear reductions are used. Thus, the output torque is limited to the motor's torque multiplied by the operating gears' reduction ratios. By comparison, when operating in the lowest speed, all the gear reductions are used and thus the output torque equals the motor's torque multiplied by all the gears' reduction ratios. As a result, a full range of torque can be applied by the output in low speed, but that range is not available in high speed. Thus, if the torque overload clutch is designed to ratchet at a maximum torque value which falls between the maximum torque output for the two speeds, then all the torque is available at low speed, but only a portion of the torque is available at high speed.

The present invention aims to ameliorate the problems with the prior art, some of which are discussed above.

BRIEF SUMMARY OF THE INVENTION

More precisely, the present invention provides a hand-held motor driven power tool, comprising; a motor having a spindle which is driven by the motor during use, a housing for the motor, a gear train having an input in connection with the motor spindle, an output for driving a tool bit, and at least one gear reduction between the input and output arranged so that, during use, the output rotates at a higher or lower rate relative to the motor spindle, said gear train being disposed in a gearbox, and a clutch mechanism arranged to interrupt drive from the motor to the output when a torque force applied to the output exceeds a predetermined torque threshold, the clutch mechanism includes a manually operable dial arranged for varying by the user the predetermined torque force at which drive is interrupted; characterised in that a portion of the clutch mechanism, such as a clutch spring or spring-loading means, is disposed in a volume defined by a portion of the motor, the motor housing and/or dial, and the gear train and/or gearbox.

The present invention also provides a hand-held motor driven power tool, comprising; a motor having a drive spindle which is driven by the motor during use, a housing for the motor, a gear train having an input in connection with the motor spindle, an output for driving a tool bit, and at least one gear reduction between the input and output arranged so that, during use, the output rotates at a higher or lower rate relative to the motor spindle, said gear train being disposed in a gearbox, and a clutch mechanism arranged to interrupt drive from the motor to the output when a torque force applied to the output exceeds a predetermined threshold, the clutch mechanism comprises a manually operable dial arranged for varying the threshold at which drive is interrupted; characterised in that the dial is disposed on or around the gearbox next to the motor housing, or between the motor housing and gearbox, or on or around the motor housing.

In a broad sense, the present invention advantageously provides a motor driven power tool in which the drive-train (which can include the motor, gear train and clutch mechanism) is compact and lightweight. In an embodiment of the present invention, this is achieved by arranging at least a portion of the clutch mechanism, such as the adjustment dial (or collar) and/or resilient spring or spring-loading means, between the motor and gear train. The clutch spring and torque adjustment dial can be arranged between the motor and gear train, and between the visible portions of the motor housing and gearbox, respectively. Advantageously, this arrangement can lead to an overall reduction in the length of the power tool. Furthermore, this arrangement leaves space free on the front end of the power tool closest to the chuck in which ancillary devices, such as work-piece illuminators can be disposed.

Preferably, the clutch mechanism comprises a clutch spring arranged for applying a spring force to a first clutch plate disposed in the gear train or on the motor spindle, which during use said spring force is applied to maintain the first clutch plate in static contact with a second clutch plate whilst the torque force applied to the output is below the predetermined threshold. The spring component can be arranged in mechanical communication with, or coupled to the dial such that rotation of the dial varies the spring force applied to the clutch plates. This arrangement advantageously allows the user to adjust the torque at which the drive train is interrupted.

In one embodiment, the clutch spring can be arranged in a volume defined by portions of the motor, the motor housing and/or dial, and the gear train and/or gearbox. Furthermore, the portion of the clutch mechanism disposed in the volume can be any one of a spring loading means, and/or the spring, and/or the first clutch plate (or any combination thereof). This arrangement can lead to an overall reduction of the power tool's length when compared to conventional tools because the spring is disposed in a space which is unutilised for this purpose in conventional power tools. The spring loading can comprise an arm or tang, a first end of which is coupled to the dial, and a second end of which engages with a series of steps, said steps having different axial lengths so that, during use, the arm is moved in an axial (longitudinal) direction with respect to the motor when the dial is rotated about the motor. The arm is preferably coupled to the spring such that the spring is compressed or decompressed by axial movement of the arm. The spring can be coupled to the dial such that rotation of the dial varies the spring force applied to the first clutch plate by the spring.

Preferably, the gear train has two or more gear reductions, and the clutch mechanism is arranged to interrupt the drive at a second gear reduction when the torque force applied to the output exceeds the predetermined threshold. This arrangement is particularly advantageous for a two speed, three-stage gear reduction where the speed change mechanism is disposed on the third gear reduction. In such a gear train, disposing the clutch on a gear which is in front of the speed change results in all the torque settings being usable across the whole predetermined threshold range for both/all speeds. Preferably the gear train comprises a switch mechanism for changing the speed of the output between a first and second speed with respect to the motor's spindle speed of rotation.

A through-pin can be arranged to transfer a load from the spring through a component of a first gear reduction and the through-pin can be arranged to be urged against a thrust plate by the spring load. In other words, the through-pin acts to transfer the spring load to the thrust plate. The thrust plate preferably comprises protrusions, or ribs extending in a radial direction, arranged to cooperate with troughs or similar ribs on a component of the second gear reduction, such that the component of the second gear reduction is moveable with respect to the thrust plate when the torque force applied to the output exceeds the predetermined threshold, and the component of the second gear reduction is held stationary with respect to the thrust plate when the torque applied to the output is below the predetermined threshold. The component of the second gear reduction can be a planet ring component of the second gear reduction. This provides a relatively compact arrangement where the spring is disposed between the motor and gear train and the clutch is arranged on the second gear reduction.

Preferably, the dial comprises a collar wrapped around the gearbox next to the motor housing, between the motor housing and gearbox, or on or around the motor housing. Preferably, the collar is flush with the outer surface of gearbox and/or motor housing. This provides a relatively compact arrangement, which is also easy to use and aesthetically pleasing.

BRIEF DESCRIPTION OF THE DRAWINGS

Embodiments of the present invention are now described by way of example, and with reference to the accompanying drawings, in which.

DETAILED DESCRIPTION OF THE INVENTION

Figure 1:
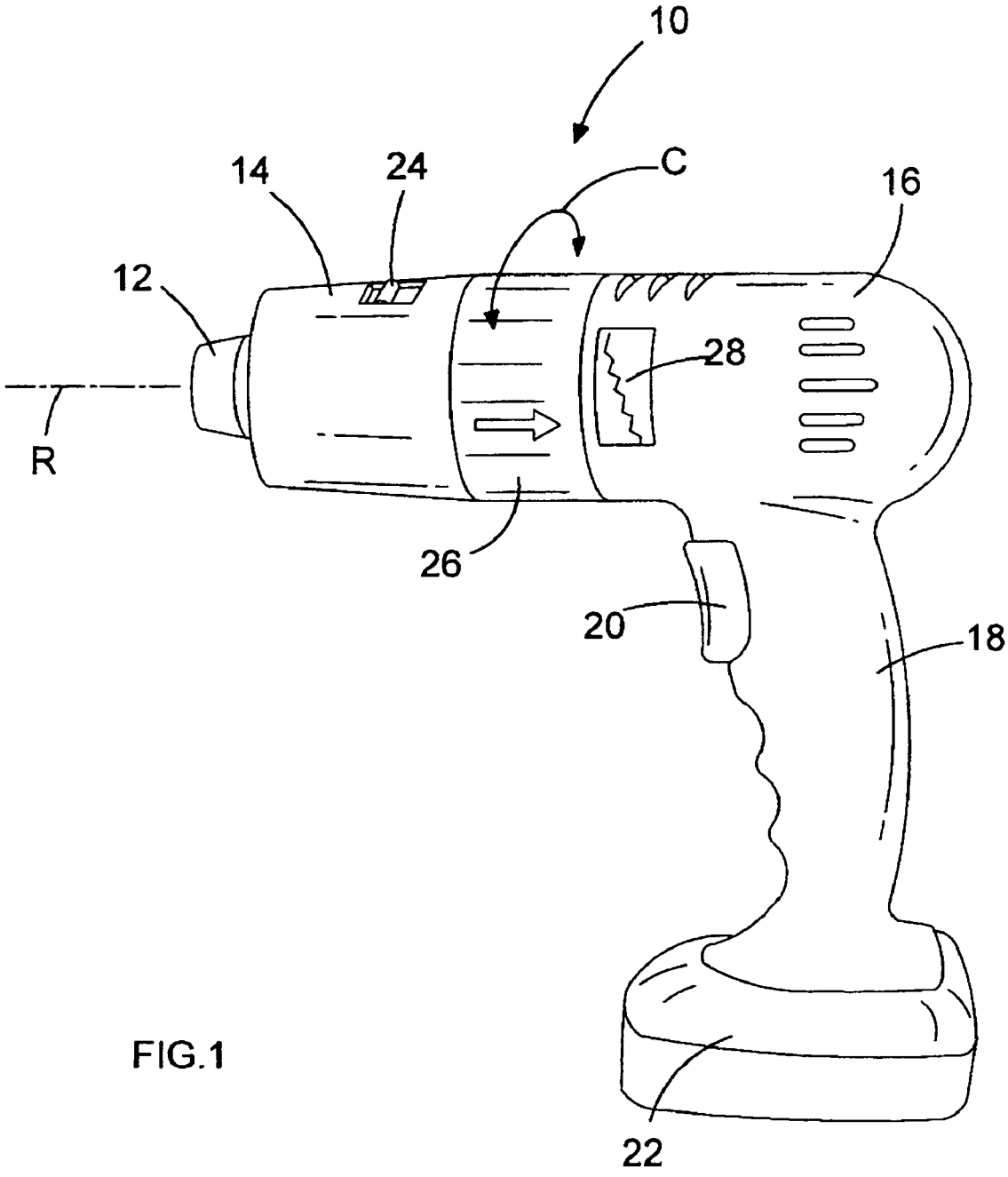
FIG. 1 is a schematic diagram showing a hand-operated motor driven screwdriver embodying the present invention.

Referring to FIG. 1, a screwdriver 10 embodying the present invention is shown. The screwdriver comprises a drive collet 12, a gearbox 14 for housing a gear train, a motor housing 16 for housing an electric motor, a grip portion 18 which includes a manually operable switch 20, and a battery pack 22 for providing power to the motor. The switch is used by the user to activate the screwdriver, in the usual manner. The gearbox includes a speed-change switch 24 which can be used to change the speed of the collet 12. In this instance, the speed-change switch provides two output speeds.

A collar or dial 26 is provided between the gearbox 14 and motor housing 16. The collar is rotatably mounted on the screwdriver between the visible portions of the gearbox and motor housing and so that it can rotate about the collet's axis of rotation R, as indicated by arrow C. The collar is provided so that the user can change the torque force at which a clutch mechanism becomes overloaded and slips or ratchets, thereby interrupting the drive from the motor to the collet. A panel 28 is provided on the motor housing which provides an indication to the user as to the relative torque forces at which the clutch overloads. A pointer on the collar can assist with this indication of clutch overload.

Figure 2:
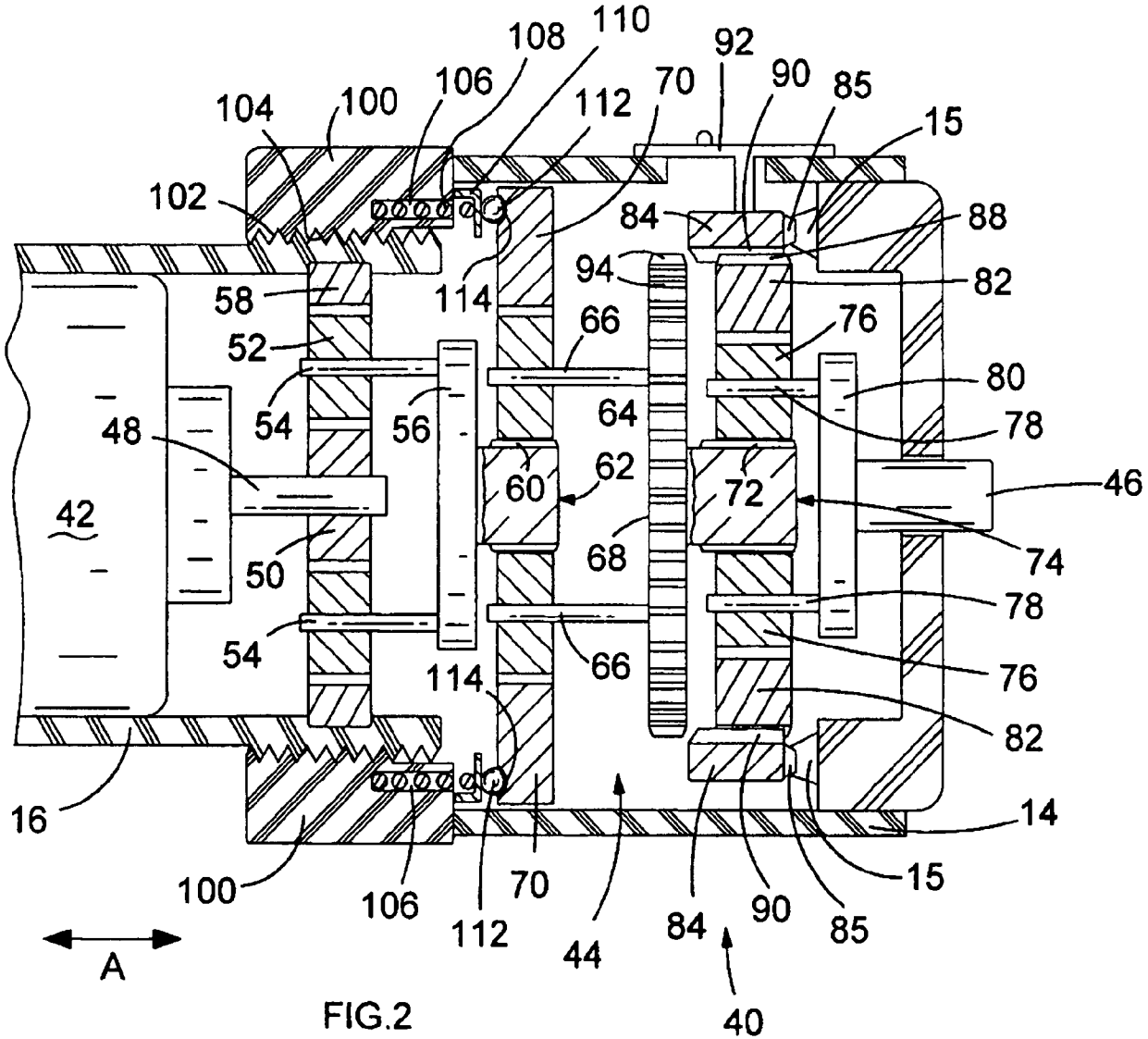
FIG. 2 is a schematic diagram showing a drive train embodying the present invention in cross section.

Referring to FIG. 2, a first embodiment of a screwdriver's drive train 40 is shown in highly schematic cross-sectional form. An electric motor 42 is disposed in a motor housing 16, and a gear train 44 is disposed in a gearbox 14. The motor has an output drive spindle 48 which rotates when the motor is activated. The gear train's output 46 is in communication with the screwdriver's collet (not shown).

A first gear 50 is rigidly mounted on to the motor's spindle 48, and thus rotates when the motor is activated. The first gear 50 is the so-called sun-gear. Three planet gears 52 (there are only two gears shown in FIG. 2 for clarity reasons) are rotatably mounted on spindles 54 of a first stage carrier 56 and are arranged to mesh with the first gear 50. A planet ring gear 58 is rigidly mounted to the motor housing 16 and the planet gears 52 mesh with the planet ring gear. Thus, rotation of the first gear 50 causes rotation of the planet gears 52, and because the planet ring 58 is mounted rigidly in the housing 16, the planet gears roll around the inside of the planet ring thus causing the first stage carrier to rotate.

A second gear 60 is formed on the front end 62 of the first stage carrier 56. Three (again, only two are shown in FIG. 2) secondary planet gears 64 are rotatably mounted on a second spindle 66 of a second stage carrier 68, and the secondary planet gears 64 are arranged to mesh with the second gear 60. Rotation of the second gear 60 causes rotation of the secondary planet gears 64.

A secondary planet ring 70 is rotatably mounted in the gearbox 14. The secondary planet ring comprises gear teeth which mesh with the secondary planet gears 64. The secondary planet ring is held stationary by a torque clutch which is arranged to prevent the secondary planet ring from rotating when a torque force applied to it is below a predetermined level. When the secondary planet ring is held stationary, the rotation of the of the secondary planet gears 64 causes them to roll around the inner surface of the secondary planet ring 70. As a result, the second stage carrier 68 also rotates. However, no rotational movement of the second stage carrier 68 results if the secondary planet ring is allowed to rotate. The torque clutch mechanism is described in more detail below.

A third gear 72 is formed on the front end 74 of the second stage carrier 68. Three (again, only two are shown in FIG. 2) tertiary planet gears 76 are rotatably mounted on a third spindle 78 of a third stage carrier 80. A third planet ring gear 82 is rotatably mounted in the gearbox and the planet ring comprises gear teeth which are arranged to mesh with the tertiary planet gears 76. The third planet ring is either held stationary relative to the gearbox, or it is allowed to rotate freely with respect to the gearbox, depending on the position of a sliding gear change ring 84.

The gear change ring 84 can slide between a first and second position relative to the gearbox. In the first position, as shown in FIG. 2, the gear change ring engages with the third planet ring and a toothed portion 15 of the gearbox 14. Thus, the portion 15 acts to prevent the gear change ring from rotating within the gearbox because the toothed portion 15 cooperates with reciprocal teeth 85 on the gear change ring. As a result, the third planet ring is held stationary with respect to the gearbox. Thus, the tertiary planet gears 76 roll around the inside of the third planet ring causing the third carrier stage 80 to rotate.

A slide toggle 92 is adapted to allow a user to manually slide the gear change ring between the first and second positions. When the gear change ring is in the second position the reciprocal teeth 85 are disengaged from the toothed portion 15 of the gearbox. Furthermore, the inner teeth 90 also engage with teeth 94 formed on the outer surface of the second carrier stage 68. Thus, the gear change ring locks the third planet ring in engagement with the second stage carrier, but the gear change ring is free to rotate relative to the gearbox. This results in the second stage carrier 68, the third gear 72, the tertiary planet gears 76 and the third planet ring 82 rotating as a single unit. In other words, the third stage carrier 80 rotates at the same rate as the second stage carrier 68.

The ratio of the rate of rotation of the third stage carrier compared to the second stage carrier is dependent on the whether the gear change ring is in the first or second position. As described above, when the gear change ring is in the second position, the ratio is 1:1. However, when the gear change ring is in the first position, the ratio is dependent on the relative sizes of the third gear 72 and the tertiary planet gears 76.

A first embodiment of the torque clutch mechanism is now described in more detail with reference to FIG. 2. The torque clutch comprises a collar 100 which surrounds the motor housing 16. A helical thread 102 is formed on the external surface of the housing and the thread 102 cooperates with a reciprocal threaded portion 104 formed on the inside surface of the collar 100. Thus, rotation of the collar about the longitudinal axis of the housing 16 causes the collar to move longitudinally along the housing. In other words, rotating the collar causes it to be screwed along the housing in a left/right direction as indicated by arrow A in FIG. 2. Latching means (not shown) could be employed to lock the collar in a predetermined position with respect to the screwdriver.

An annular recess 106 is formed in the collar to accommodate a resilient spring 108. In its relaxed state, the spring extends beyond the collar, out of the recess. A thrust plate 110 is disposed on the end of the spring which is exposed from the recess and the thrust plate engages with ball bearings 112. Thus, the ball bearings 112 are urged by the compressed spring into reciprocal indents 114 disposed on the secondary planet ring 70 (when the indents are aligned with the balls).

The application of a torque force to the secondary planet ring, which force exceeds the urging force applied by the spring to the balls via the thrust plate, causes the secondary planet ring to rotate with respect to the gearbox. The balls are forced out of the indents and the balls roll along side face of the secondary planet ring until they engage with another indent. This process repeats itself until the torque force applied to the secondary planet ring is removed or until the force no-longer exceeds the spring force. Whilst the secondary planet ring rotates, no rotational movement is transferred to the second carrier stage 56. In this state (that is, when the clutch is overloaded), the drive train is said to be stalling.

The spring force is adjusted by rotating the collar, thus adjusting the compression of the spring. In FIG. 2, the spring is shown in its most compressed state, thus requiring a relatively high torque to stall the drive train. Rotation of the collar so that the spring is more relaxed results a relatively low spring force being applied to the balls, and hence a relatively low torque is required to stall the drive train.

It might be necessary to provide a curtain or bellows arrangement between the collar and gearbox to prevent the spring and/or other portions of the clutch mechanism from becoming exposed when the collar is set for a low torque overload force. Alternatively, the collar can be arranged to overlap a portion of the gearbox so that the spring is never exposed during normal operation.

Figure 3:
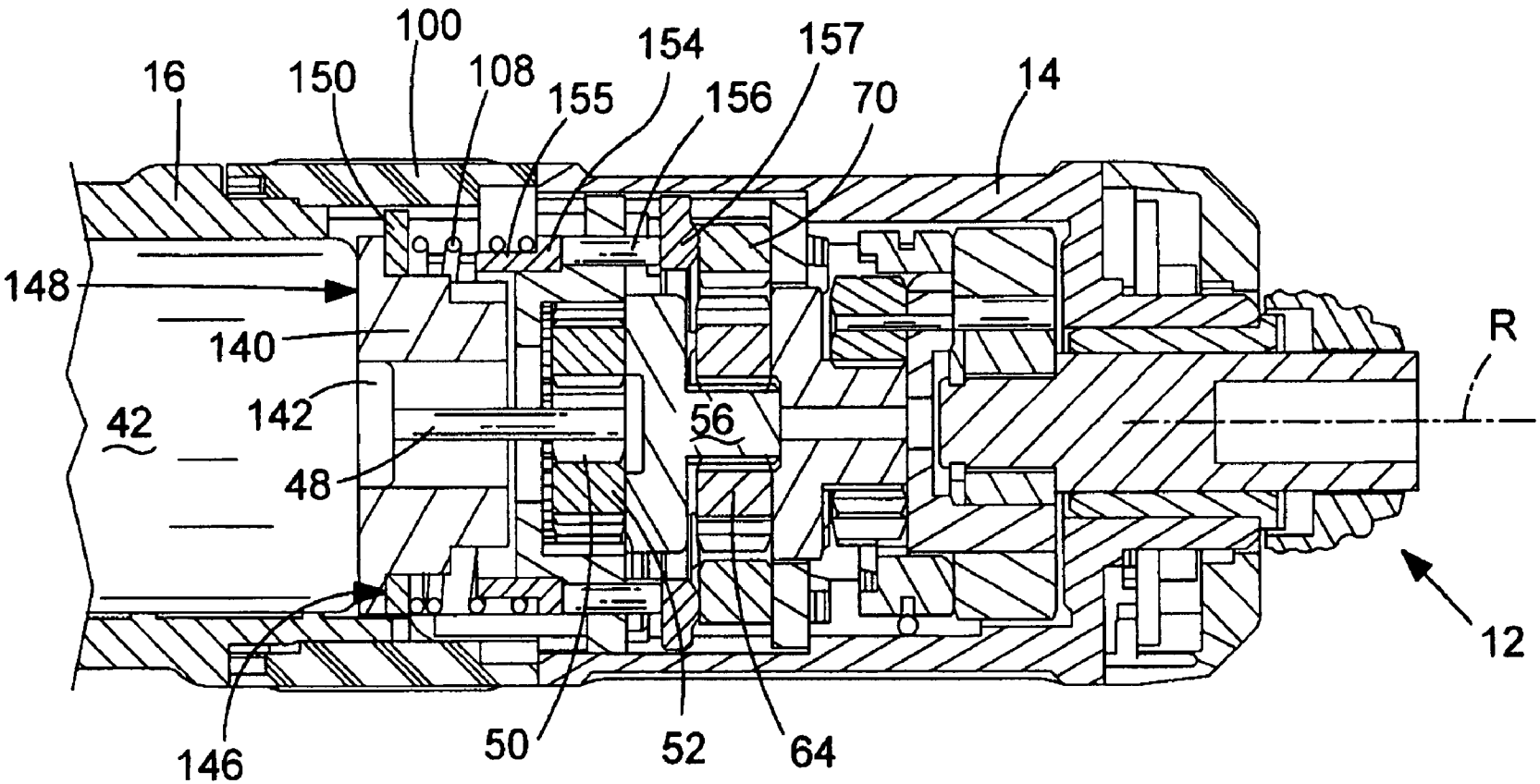
FIG. 3 is a schematic diagram showing in cross section a portion of another drive train embodying the present invention.

A second embodiment of the torque clutch mechanism is now described in more detail with reference to FIGS. 3, 4 and 5. Components of the second embodiment which are common with the first embodiment described above are allocated the same indication numerals. FIG. 3 shows the motor 42, first epicyclical gear and a part of the second gear reduction. The torque overload clutch comprises a collar 100 disposed substantially between visible portions of the motor's housing 16 and the gearbox 14. As for the previous embodiment, the collar is rotatably mounted on the screwdriver about the longitudinal axis.

A buttressed turret 140 is disposed over and around the neck portion 142 and spindle of the motor 42 and the turret is fixed so that it can not move relative to the motor. The buttresses are formed as shelf-like 144 features around the periphery of the turret (see FIGS. 4 and 5 also) with adjacent buttresses having ever increasing "height". By "height" it is meant the distance from the top surface 146 of a given shelf or buttress on the turret to the motor-end 148 of the turret.

An arm 150 provides a mechanical link or coupling between the turret and the collar, such that twisting of the collar causes the arm to rotate with respect to the longitudinal axis of the screwdriver. As the arm is rotated it rides over the top surfaces 146 of buttresses and thus an axial movement of the arm also occurs during collar twisting. A washer 152 can be disposed on the arm to form a base on which an end of the spring 108 engages. The other end of the spring engages with a ring-plate 154. The ring-plate 154 is in engagement with one or more through-pins 156 which passes through or along-side the planet ring 58, said planet ring forming an integral part of the gearbox. The end of the through-pin furthest from the motor engages with a thrust plate 157. The thrust plate has a surface (157' in FIG. 5) which faces the side face of the secondary planet ring 70. Both the thrust plate surface and planet ring surface have a series of protrusions 158 and 71 respectively, and/or troughs, which cooperate with one another. Preferably, the protrusions are formed as ribs extending in a radial direction. The ribs should have sufficient height to allow engagement and cooperation with the ribs on the other plate/surface. A height of 0.5 mm for both sets of ribs has proved sufficient for a clutch which can withstand 6 Nm of torque before ratcheting. Of course, the torque exerted depends on the geometry of the gear train, as well as the spring force exerted by the spring.

The spring 108 is arranged to urge, via the through-pins 156, the thrust plate 157 and secondary planet ring in to contact with each other. Thus, the second planet ring can be held stationary with respect to the motor housing by the thrust plate. However, if a torque force applied to the second carrier 68 exceeds the spring force urging the thrust plate and second planet ring in contact with each other, then the second planet ring rotates with respect to the motor housing; the peaks on one surface are able to ride out of the troughs (or over the ribs) on the other surface and the drive train stalls.

As stalling occurs and the protrusions ride over one another, the thrust plate moves axially towards the motor. This axial movement causes the through-pins 156 and hence the ring-plate 154 to also move in an axial direction towards the motor. This causes the spring to become slightly more compressed against the washer 152, or hoop 165 (shown in FIG. 5).

The spring force urging the thrust plate in contact with the second planet ring can be adjusted by varying the compression of the spring. This is achieved by rotating the collar 100 which causes the arm to move longitudinally and thus compress or relax the spring, according to the direction in which the collar is rotated. Thus, the torque at which the clutch overloads, or at which the drive trains stalls, can be varied.

The collar 100 can be arranged to have a low-profile such that it fits flush with the respective outer surfaces of the gearbox and/or motor housing. To achieve this, the collar can be fitted into a relatively shallow trench formed on either the outer surfaces of the gearbox and/or the motor housing.

Figure 4:
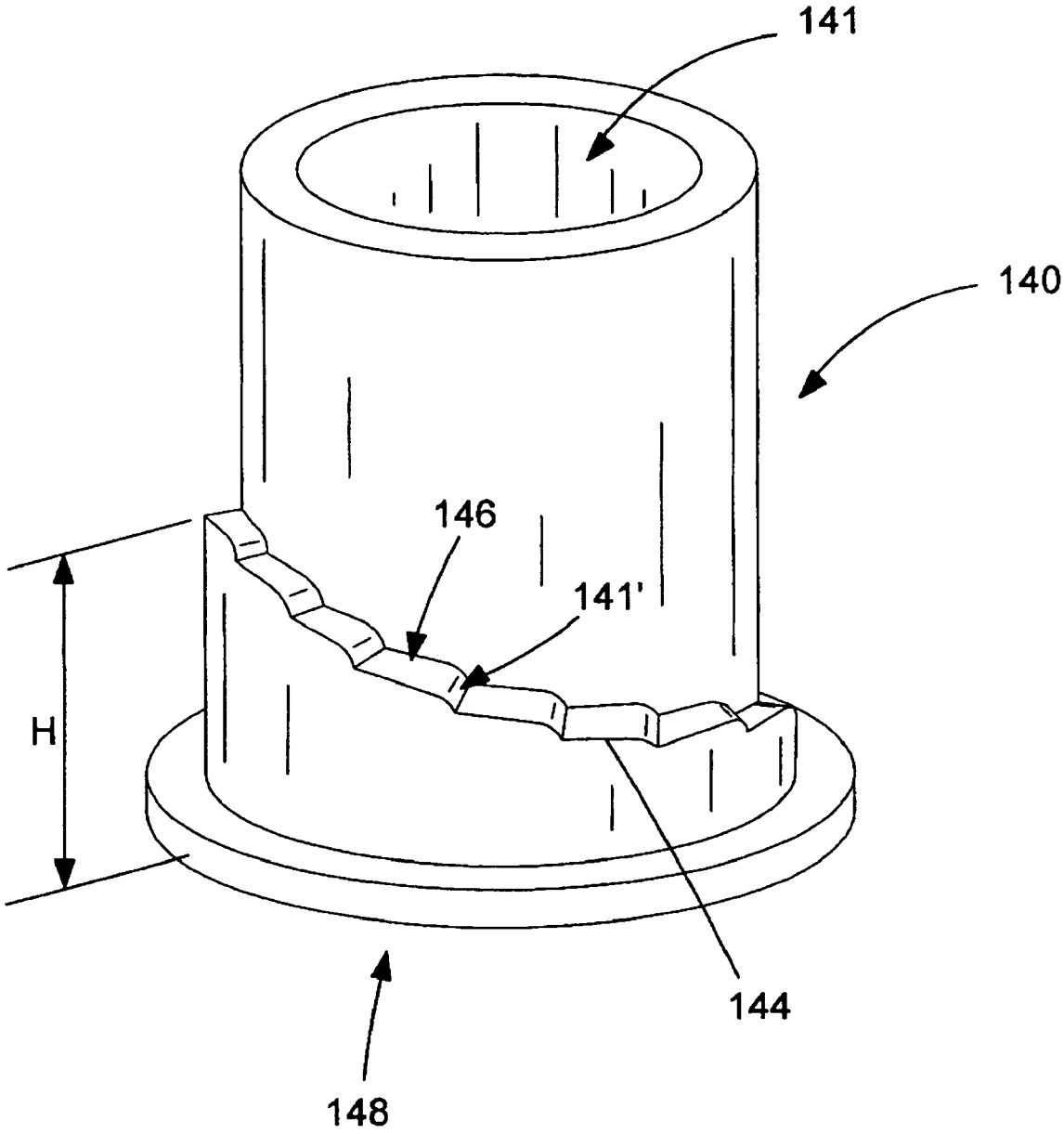
FIG. 4 is a schematic diagram showing a component of the drive train shown in FIG. 3.

FIG. 4 shows the turret 140 in more detail. The hollow turret is formed as a cylindrical shape, through the centre 141 of which the motor's spindle can pass. The outer cylindrical surface comprises a series of steps, or shelf-like features 144 with ever increasing height H, as described above. Each step has a sloping leading surface 141' which is arranged to allow the arm 150 to ride over the steps with relative ease. One or more series of corresponding steps can be arranged diametrically opposite to steps shown in FIG. 4. If more than two series of steps are provided they can be arranged at regular intervals around the turret, for instance at 120 degree intervals for three series of steps, and at 90 degree intervals for four series of steps, and so on. As described above, an arm linked to the collar is arranged to rest on the top surface of the step, and this arm is displaced axially in a longitudinal direction when the collar is rotated. The steps can have a concave surface (on which the arm is arranged to engage) to provide positive indexing of the torque adjustment mechanism. Alternatively, or in addition, indexing means can be provided between the dial 100 and motor housing and/or the gearbox.

Figure 5:
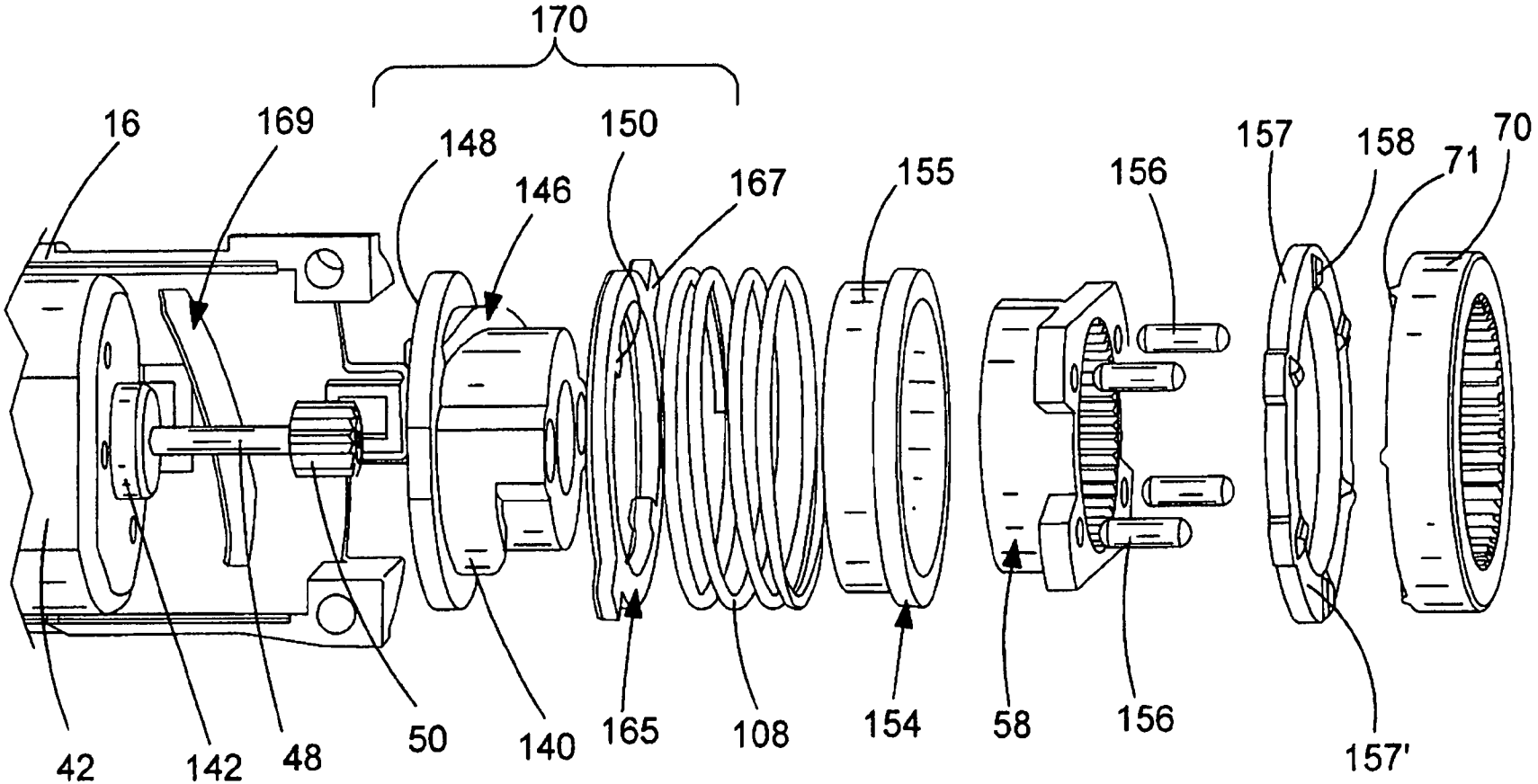
FIG. 5 is a schematic diagram showing an exploded view of components which make up the clutch mechanism shown in FIG. 3.

FIG. 5 shows the components described above, which make up at least a portion of the clutch mechanism, in an exploded view (the first planetary gears 52, spindle 54, carrier 56 and second planetary gears 64 are not shown in this figure for clarity purposes). Components described above and shown in previous figures have the same reference numerals. The arm 150 is shown as an integral part of a hoop or washer component 165. The arm 150 extends in a radial direction from the hoop towards the centre of the hoop. A tang 167 extends in a radial direction outwardly from the hoop 165. It is appreciated that the tang and arm are effectively a single component held in position by the hoop; the tang is an extension of the arm and forms an end of the arm. The tang 167 is arranged to pass through a slot 169 in the motor housing 16. Thus, the tang can engage with a groove on the inner surface of the collar 100, such that twisting of the collar around the housing 16 causes the tang, and hence the hoop 165, to rotate. This rotation of the hoop causes the arm to ride over the turret's stepped surface 146, which in turn causes the hoop to move in an axial direction, and thus compress or decompress the spring 108. In other words, the collar, tang, arm, hoop, and turret act as a spring compressing means 170 and the compression of the spring is dependent on the disposition of these components.

The clutch can be locked in an inoperable state where the hoop is in contact with the end of the ring-plate 154 nearest the motor. Thus, the ring-plate can not move in an axial direction towards the motor. As a result, the clutch plate 157 is held in contact with second gear planet ring 70. In order to achieve this, the ring plate 154 has an extending portion 155, around which the spring can be wrapped. The spring 108 should be arranged so that its axial length in a fully compressed state is less than the axial length of the extending portion 155 of the ring plate 154. In this locked or inoperable state the clutch should not ratchet, which is particularly useful for drilling operations, for instance.

The embodiments described provide a compact power tool transmission. This is achieved by arranging the clutch mechanism around the gear train, around a portion of the motor, and/or in a space between the motor and gear train. By comparison, a conventional clutch mechanism is arranged with at least a portion of the clutch being disposed around the gear train's output spindle. Thus, embodiments of the present invention can provide a power tool of considerably shorter length compared to conventional units. Furthermore, some components of the clutch described in the second embodiment utilises a space or volume defined by a part of the motor, the gear train, and either the motor housing and/or gearbox. Thus, further compactness is achieved compared to conventional power tool clutch mechanisms. Disposing the clutch mechanism's adjustment collar towards the rear of the gear train leaves a space unutilised at the front end of the power tool. This unutilised space can be used to provide an area in which illuminating devices can be disposed to illuminate the work-piece, for instance.

Although the above description is limited to planetary gears, the present invention might be equally applicable to other forms of gear trains.

Alternative arrangements to the embodiments described above may be envisaged by the skilled person. For instance, the clutch mechanism might be disposed on the first gear reduction, as opposed to the second gear reduction. Such an arrangement could simplify the gearbox because through-pins might not be necessary to transfer the spring force to the clutch plates.

The invention claimed is:

1. A hand-held motor driven power tool, comprising:

a motor housing, a motor disposed in the motor housing and having a motor spindle driven by the motor during use, a gear box, a gear train disposed in the gear box and including an input gear connected to the motor spindle, an output spindle for driving a tool bit, and at least a first gear reduction between the input gear and the output gear arranged so that, during use, the output spindle rotates at a higher or lower rate relative to the motor spindle, and a clutch mechanism arranged to interrupt drive between the motor to the output spindle when a torque force applied to the output spindle exceeds a predetermined threshold, a manually operable dial connected to the clutch mechanism for varying the threshold at which drive is interrupted; and wherein the clutch mechanism is bounded by the motor on a first side of the clutch mechanism, the gear train on a second side of the clutch mechanism and the dial on a third side of the clutch mechanism.

2. A power tool according to claim 1, wherein the clutch mechanism comprises:

a first clutch plate, a second clutch plate, and a spring connected to the dial and arranged for applying a spring force to the first clutch plate, the spring force acting to maintain the first clutch plate in static contact with the second clutch plate whilst the torque force applied to the output spindle is below the predetermined threshold, the spring connected to the dial such that rotation of the dial varies the spring force applied to the first clutch plate.

3. A power tool according to claim 2, wherein the spring is arranged in a volume bounded by the motor, the gear train, and at least one of the motor housing, the dial, and the gear box.

4. A power tool according to claim 2, wherein the gear train includes a second gear reduction, and the clutch mechanism is disposed on a component of the second gear reduction.

5. A power tool according to the claim 4, wherein a through-pin is arrange to transfer the spring force from the spring past a component of a first gear reduction.

6. A power tool according to claim 5, wherein the through-pin is arranged to be urged against the second clutch plate by the spring force.

7. A power tool according to claim 2, wherein the first clutch plate comprises a first cooperating surface arranged to interact with a second cooperating surface on the second clutch plate; and the second clutch plate comprises a component of a second gear reduction, such that the component of the second gear reduction is moveable with respect to the first clutch plate when the torque force applied to the output spindle exceeds the predetermined threshold; and wherein the component of the second gear reduction is held stationary with respect to the first clutch plate when the torque applied to the output spindle is less than the predetermined threshold.

8. A power tool according to claim 7, wherein said component of the second gear reduction is a planet ring gear of the second gear reduction.

9. A power tool according to claim 7, wherein the first cooperating surface is one of a protrusion and a trough, and the second cooperating surface is one of a protrusion and trough.

10. A power tool according to claim 1, wherein the gear train includes a mechanical speed-change mechanism for changing the output speed of the power tool, and wherein the clutch mechanism is arranged to interrupt the drive train at a location before the speed-change mechanism.

11. A power tool according to claim 1, wherein ad clutch mechanism comprises a spring-loading means, a spring, and a first clutch plate.

12. A power tool according to claim 11, wherein the spring-loading means comprise an arm having a first end and second end, the first end of the arm is in engagement with the dial, and the second end of the arm engages with a series of steps, said steps having different axial lengths so that, when a user rotates the dial, the arm is moved in an axial direction with respect to the motor.

13. A power tool according to claim 12, wherein the arm is coupled to the spring such that the spring is compressed and decompressed by axial movement of the arm.

14. A power tool according to claim 11, wherein the spring is connected to the dial via spring-loading means such that rotation of the dial varies the spring force applied to the first clutch plated by the spring.

15. A power tool according to claim 1, wherein the dial comprises a collar that is one of: wrapped around the gear box next to the motor housing, wrapped between the motor housing and the gear box, and wrapped around the motor housing.

16. A power tool according to claim 15, wherein the collar is flush with one of an out surface of the gear box and an outer surface of the motor housing.

17. A power tool according to claim 15, wherein the dial is disposed either on or around the gear box next to the motor housing, between the motor housing and the gear box, or on the motor housing.

18. A hand-held motor driven power tool, comprising:

a motor housing having a front end and a rear end, a motor disposed in the motor housing and having a motor spindle driven by the motor during use, a gear box having a gear box front end and a gear box rear end, the gear box rear end proximate to the motor housing front end, a gear train disposed in the gear box and including an input gear connected to the motor spindle, an output spindle for driving a tool bit, and at least one gear reduction between the input gear and the output spindle arranged so that, during use, the output rotates at a higher or lower rate relative to the motor spindle, a clutch mechanism arranged to interrupt drive between the motor and the output spindle when a torque force applied to the output spindle exceeds a predetermined threshold, a manually operable dial connected to the clutch mechanism for varying the threshold at which drive is interrupted; and wherein the dial is located between the motor housing front end and the gear box rear end.

19. A hand-held motor driven power tool, comprising:

a motor housing, a motor disposed in the motor housing and having a motor spindle driven by the motor during use, a gear box located forward of the motor housing, a planetary gear train disposed in the gear box and including an input gear connected to the motor spindle, an output spindle for driving a tool bit, a first stage ring gear and a second stage ring gear located between the input gear and the output spindle, a clutch means for interrupting drive between the motor and the output spindle when a torque force applied to the output spindle exceeds a predetermine threshold, a manually operable clutch adjustment means for varying the threshold at which drive is interrupted; and wherein the clutch adjustment means is located between the motor housing and the second stage ring gear.

20. A hand held power tool according to claim 19, further comprising a speed control means for adjusting the speed of the output spindle, and wherein the clutch adjustment means is located rearward of the speed control means.

* * * * *